United States Patent [19]

Sverchkov et al.

[11] 4,008,673

[45] Feb. 22, 1977

[54] BUOYANCY CONTROL SYSTEM FOR SUBMERSIBLE VESSELS

[76] Inventors: Jury Sergeevich Sverchkov, Bolshevistsky pereulok 13/3, kv. 7; Nadezhda Nikolaevna Balashova, Novoslobodskaya ulitsa, 50/52, kv. 27; Viktor Mikhailovich Popel, ulitsa Karla Marxa, 20 korpus 2, kv. 100; Viktor Petrovich Shmatok, Amurskaya ulitsa, 76, korpus 3, kv. 10, all of Moscow, U.S.S.R.

[22] Filed: Aug. 7, 1975

[21] Appl. No.: 602,743

[52] U.S. Cl. ..... 114/16 E

[51] Int. Cl.[2] ..... B63G 8/00

[58] Field of Search ..... 114/16 E, 16 R, 16 A, 114/50, 52, 54, 235 B, 121, 125; 61/69 R, 69 A; 9/8 R

[56] References Cited

UNITED STATES PATENTS

| | | | |
|---|---|---|---|
| 2,972,972 | 2/1961 | Allen | 114/16 E |
| 3,301,209 | 1/1967 | Caldwell | 114/16 E |
| 3,626,881 | 12/1971 | Lovingham | 114/16 E |

FOREIGN PATENTS OR APPLICATIONS

| | | | |
|---|---|---|---|
| 414,562 | 8/1931 | Germany | 61/69 |

*Primary Examiner*—Trygve M. Blix
*Assistant Examiner*—Charles E. Frankfort
*Attorney, Agent, or Firm*—Haseltine, Lake & Waters

[57] ABSTRACT

A reservoir with ballast liquid is mounted outside the hull of a vessel and secured thereto. Likewise outboard, there is mounted on the vessel hull a coiled pipe exposed to the surrounding sea water at one end and communicating with the reservoir at the other end. A pump is provided for transferring the ballast liquid from the reservoir to the pipe and back from the pipe to the reservoir. Inside the pipe there is movably mounted a piston separating the ballast liquid from the sea water.

2 Claims, 1 Drawing Figure

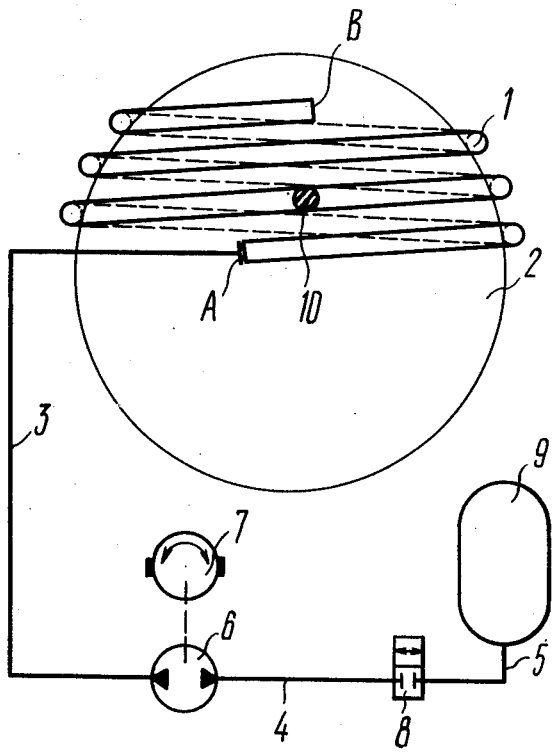
B
1
2
A
10
3
9
7
6
5
4
8

BUOYANCY CONTROL SYSTEM FOR SUBMERSIBLE VESSELS

BACKGROUND OF THE INVENTION

The present invention relates to an improvement in submersible vessels and, more particularly, to an improved buoyancy control system for submersible vessels which may be successfully employed with such vessels as "Dean", "Star", "Daub" and the like.

It is currently known in the art to employ a variety of buoyancy control systems. Wide use is made of buoyancy control systems built around a distensible or flexible chamber filled with a ballast liquid, such as, for example, the system described in U.S. Pat. No. 3,301,209. The latter buoyancy control system comprises a distensible or flexible chamber with distensible members connected via a system of conduits and a pump to a second, water-tight and rigid chamber. The latter may either be formed by a special tank or else it may be formed directly within the pressure hull of the vessel by installing therewithin a special rigid water-tight bulkhead. Buoyancy is controlled by varying the ratio of liquid volumes in the distensible and rigid chambers, with the buoyancy being increased by transferring the liquid from the rigid chamber to the distensible chamber via the conduits against the hydrostatic pressure of the surrounding sea water exerted on the distensible member. As the distensible chamber receives additional quantities of the liquid from the rigid chamber, the former's volume increases, consequently increasing the buoyancy. To decrease the buoyancy of the submersible vessel, the liquid from the distensible chamber is driven to the rigid one by the hydrostatic pressure of the surrounding sea water to which the distensible member is exposed.

One of the disadvantages of the above-described system is associated with the need for a chamber made of a distensible material, since materials of this kind age relatively quickly and are relatively susceptible to rupture. The latter circumstance necessitates special guard arrangements to protect the distensible chamber from mechanical damage, adding to the complexity of design and increasing the weight of the buoyancy control system.

A further disadvantage of this prior art system consists in the need for precision adjustment of the chamber position: the chamber must be disposed close to the axis passing through the center of buoyancy and the center of gravity of the submersible vessel, or otherwise buoyancy regulation may be fraught with the risk of heeling or trim difference of the vessel.

OBJECTS OF THE INVENTION

It is an object of the present invention to provide for a longer service life of the buoyancy control system of submersible vessels.

It is another object of the present invention to provide a buoyancy control system for submersible vessels requiring no special guard arrangements.

SUMMARY OF THE INVENTION

These and other objects are attained in accordance with this invention by providing a buoyancy control system which comprises an outboard tank open to the surrounding sea water and a reservoir filled with a ballast liquid serving to fill or drain the tank with the aid of a pump, the outboard tank being formed as a coiled pipe fastened to the hull of the submersible vessel, one end of the coiled pipe being open to the surrounding sea water and the other end thereof being connected through the pump to the reservoir, there being provided a movable piston mounted in the coiled pipe and serving to separate the sea water entering the coiled pipe from the ballast liquid.

In the system of the foregoing design, the volume filled by the ballast liquid in the pipe varies, causing a variation in the buoyancy of the vessel, holding constant weight, which permits employing a constant-size outboard tank, i.e. an outboard tank constructed from a strong rigid material.

THE DRAWING

The invention will be further understood from the following description of a preferred embodiment thereof taken in conjunction with the accompanying sole drawing schematically illustrating a submersible vessel equipped with a buoyancy control system in accordance with the invention.

DESCRIPTION OF PREFERRED EMBODIMENT

Referring now to the drawing, illustrated therein is a buoyancy control system comprising a coiled pipe 1 constructed from a metal or plastic material. The coiled pipe 1 is wound about and fastened to a pressure hull 2 of the submersible vessel. One end A of the coiled pipe 1 is connected, via conduits 3, 4 and 5 through a reversible pump 6 fitted with a drive 7, and a cock 8, to a reservoir 9 constructed from a strong material, e.g. a metal. The other end B of the coiled pipe 1 is exposed to the surrounding sea water. The reservoir 9 rigidly connected to the pressure hull 2 of the submersible vessel is filled with a ballast liquid, e.g. fluid oil (the connection of the reservoir with the hull is not shown in the drawing). To minimize the weight of the vessel, the ballast oil preferably has a lower specific gravity than water. The volume of the ballast fluid governs the buoyancy control range and is accordingly selected on the basis of the requirements to the submersible vessel and the purpose for which it is built.

The inner space of the coiled pipe 1 and the inner space of the reservoir 9 must be sufficient for each to accommodate the entire volume of the ballast liquid. A piston 10 serving to separate the ballast liquid from the sea water is installed in the coiled pipe 1. Said piston 10 may be for instance, a soft rubber ball of sufficient size to ensure separation of the ballast water from the sea water, a further requirement being that the friction of the piston 10 against the walls of the pipe 1 should be small enough to permit the piston to be driven along the pipe by a relatively small force. The piston 10 moves in the pipe 1 as the ballast liquid is transferred by the pump from the reservoir to the pipe and back from the pipe to the reservoir. The cock 8 serves to disconnect the conduits 4 and 5 while the pump 6 is out of operation so as to prevent the ballast liquid from flowing from the pipe 1 to the reservoir 9 and back from the reservoir 9 to the pipe 1.

The proposed buoyancy control system operates as follows.

To increase the buoyancy of the submersible vessel, the cock 8 interconnecting the conduits 4 and 5 and the drive 7 are actuated. The pump 6 delivers the ballast liquid from the reservoir 9 via the conduits 3, 4 and 5 to the coiled pipe 1, the piston 10 moving along the pipe 1 and forcing the sea water therefrom through the open end thereof. The displacement of the buoyancy control system and thus of the submersible vessel increases by a value equivalent to the volume of the ballast liquid transferred. As soon as the desired buoyancy has been attained, the drive 7 and the cock 8 are deenergized. The pump 6 ceases transferring the ballast liquid, and the cock 8 closes, blocking the passage of the ballast liquid from the coiled pipe 1 to the reservoir 9 or back from the reservoir 9 to the coiled pipe 1.

To decrease the buoyancy of the submersible vessel, the cock 8 is opened, interconnecting the conduits 4 and 5, and the drive 7 is actuated to rotate in the opposite direction, causing the pump 6 to transfer the ballast liquid from the coiled pipe 1 via the conduits 3, 4 and 5 and into the reservoir 9, the piston 10 moving in the coiled pipe 1 and thereby drawing the surrounding sea water thereinto via the open end thereof. The displacement of the buoyancy control system and thus of the submersible vessel decreases by a value equivalent to the volume of the ballast liquid transferred. As soon as the desired buoyancy has been attained, the drive 7 and the cock 8 are deenergized. The pump 6 consequently ceases transferring the ballast liquid, and the cock 8 closes, preventing the ballast liquid from flowing from the coiled pipe to the reservoir 9 and back from the reservoir 9 to the coiled pipe 1.

What is claimed is:

1. A buoyancy control system for submersible vessel, comprising a reservoir filled with a ballast liquid and secured to the hull of a submersible vessel, an outboard pipe fastened to the exterior of said hull and open at one end to the sea water normally surrounding the vessel, the other end of said pipe communicating with said reservoir, a piston movably mounted within said pipe and separating the ballast liquid from sea water entering said pipe, and a pump for transferring said ballast liquid from said reservoir to said pipe and back to said reservoir.

2. A system as set forth in claim 1, wherein the pipe is in the form of a coil enveloping the hull of the vessel.

* * * * *